United States Patent [19]

Roberts

[11] 4,225,299

[45] Sep. 30, 1980

[54] APPARATUS FOR EXTRUDING YARN

[75] Inventor: John S. Roberts, Ellicott, Md.

[73] Assignee: Kling-Tecs, Inc., Mantoloking, N.J.

[21] Appl. No.: 893,370

[22] Filed: Apr. 4, 1978

[51] Int. Cl.[3] ..... B29C 25/00

[52] U.S. Cl. ..... 425/72 S; 264/176 F; 264/237; 425/382.2; 425/462

[58] Field of Search ..... 425/71, 72 S, 382.2, 425/462; 264/176 F, 237

[56] References Cited

U.S. PATENT DOCUMENTS

| | | | |
|---|---|---|---|
| 3,210,451 | 10/1965 | Manning et al. | 425/72 S |
| 3,266,969 | 8/1966 | Makansi | 264/176 F |
| 3,335,210 | 8/1967 | Vinicki | 425/72 S |
| 3,489,832 | 1/1970 | Burton et al. | 264/237 |
| 3,562,369 | 2/1971 | Chopra et al. | 425/72 S |
| 3,719,442 | 3/1973 | Schippers et al. | 425/72 S |
| 3,881,850 | 5/1975 | Stockbridge | 425/72 S |
| 3,902,833 | 9/1975 | Matovinovic | 425/72 S |
| 4,045,534 | 8/1977 | Fisher et al. | 264/176 F |
| 4,077,752 | 3/1978 | Zahn | 425/72 S |

FOREIGN PATENT DOCUMENTS

| | | | |
|---|---|---|---|
| 1953461 | 5/1971 | Fed. Rep. of Germany | 425/72 S |
| 2218239 | 11/1972 | Fed. Rep. of Germany | 264/176 F |
| 2345511 | 3/1975 | Fed. Rep. of Germany | 264/237 |
| 2349832 | 4/1975 | Fed. Rep. of Germany | 264/237 |
| 42-2931 | 2/1967 | Japan | 264/176 F |
| 43-6093 | 3/1968 | Japan | 425/382.2 |
| 44-21169 | 9/1969 | Japan | 264/176 F |
| 48-32614 | 10/1973 | Japan | 264/237 |

*Primary Examiner*—Jay H. Woo

*Attorney, Agent, or Firm*—Albert C. Nolte, Jr.; Edward B. Hunter

[57] ABSTRACT

Air quench extrusion apparatus and method are described for extruding yarn from polyolefin material. The yarn is first extruded downwards into a hot zone surrounded by a shroud, and then passes through a quenching zone across which cooling air, or gas, is moved to cool the yarn. Immediately adjacent the lower end of the quenching zone is disposed a denier control roll for pulling the yarn out of the quenching zone at a controlled rate causing the yarn to be drawn down in denier in the hot zone. The hot zone is small in volume relative to the quenching zone and contains quiescent air at a temperature close to that at which the material is extruded. The height of the apparatus from extrusion to the denier control roll is less than 10 feet, allowing the apparatus to be located in a single story building. At least two multi-filament yarns are simultaneously extruded into the hot zone which is rectangular in cross-section.

5 Claims, 9 Drawing Figures

APPARATUS FOR EXTRUDING YARN

BACKGROUND OF THE INVENTION

Conventional air quench extrusion apparatus of 'down-the-stack' type for spinning polypropylene yarn is several stories high and usually requires to be housed in at least a three story building. The extruder is located on an upper floor, the air quench cabinets are located on the next lower floor and may be six or seven feet in height, and below the air quench cabinets are long inter-floor tubes which extend down to a third or fourth floor. Below each inter-floor tube, which may be eighteen feet long, denier control rollers are positioned for pulling the yarn down through the 'stack' with the denier of the undrawn yarn being determined by the drawn-down of the filaments in the quenching zone.

Disadvantages of this type of apparatus are its height, so requiring a special building, the complication of having operators on different floors, and the cost to build and install it.

One story air quench extrusion apparatus for producing polypropylene yarn are also known, but these have been found to have the disadvantage that they tend to produce less uniform yarn. There tend to be undesirable variations in denier from filament to filament and non-uniformily of denier along the length of a filament. Such yarn is usually cut up into staple fiber as it is not suitable, for example due to filament breaks during drawing, to be used as a textile quality continuous filament yarn.

It is surmised that to reduce the height, or length, or air quench extrusion apparatus for producing polypropylene yarn, the melt should be extruded at lower temperatures than in conventional 'down-the-stack' apparatus, if the yarn is to be adequately and correctly cooled before it reaches the denier control rollers. It is also surmised that the use of lower temperatures normally contributes to denier irregularities and spinning breaks.

SUMMARY OF THE INVENTION

The present invention is based on the theory that by extruding the yarn into a hot zone before air quenching it, it is possible to extrude at lower temperatures and reduce the filament denier irregularies and spinning breaks that might otherwise occur. This theory is applied to provide one story air quench extrusion apparatus that can make at least some textile quality continuous filament polypropylene yarn. In a preferred embodiment of the invention, this theory is used to shorten conventional 'down-the-stack' extrusion apparatus to enable it to fit in one story of a building.

One aspect of the invention provides air quench extrusion apparatus having a first zone into which at least one filament of polyolefin material is extruded, said first zone being adapted to prevent substantial cooling of the filament as it passes therethrough, a second zone disposed downstream of said first zone, gas moving means for moving cooling gas, preferably air, through said second zone to cool the filament, and denier control means for pulling said filament out of said second zone, said denier control means being disposed immediately adjacent said second zone. In operation the temperature in said first zone should preferably be maintained at or slightly below the temperature at which the filament is extruded. The length of the path of said filament from extrusion to said denier control means may be less than ten feet. Said first zone may be less than two feet long, preferably less than eighteen inches long, and may even be less than one foot long. The length of said second, or quenching, zone may be less than six feet, and is desirably less than five feet. Said denier control means may be less than eight feet below the bottom of said first zone.

The length of said first zone may be less than one third that of the second zone. Preferably the volume of said first zone should be small, for example less than one tenth the volume of said second zone.

The first zone may be surrounded by a wall arranged to protect the filament or filaments while passing therethrough from disturbance by outside air, and air in said first zone may be substantially restricted from escaping therefrom, thus enabling the temperature of the air in said first zone to reach and remain close to the temperature of extrusion.

The invention also provides a method of producing filaments of polyolefin material by air quench extrusion comprising extruding the filaments into a first zone containing hot quiescent air, passing the filaments through a quenching zone through which cooling air is blown to cool said filaments, and contacting the cooled filaments with one or more denier control rolls to pull the filaments out of said quenching zone at a controlled rate causing the filaments to be drawn down in denier in said first zone; the length of the path of the filaments from extrusion to contact by said denier rolls being less than ten feet, thus enabling the process to be carried out in a single story building.

A specific embodiment of the invention will now be described in greater detail with reference to the accompanying drawings.

BRIEF DESCRIPTION OF THE DRAWINGS

An extruder 11 is supported on a framework 12 and has infeed hopper 13. Although not shown, inside the extruder is a screw rotatable in a barrel which is surrounded by band heaters as is well known in the art. The screw is driven by a motor 14 via endless belts and a reduction gear box 15. At the discharge end of the extruder 11 is mounted a screen shifter 16 which is connected to a transfer tube 17 which in turn, after turning downwards, is connected to a distribution manifold 18 (see FIGS. 2 and 4). the distribution manifold 18 has four legs with passages 19, 20, 21 and 22 therethrough. The passages 19 and 20 are connected together at an orifice 23 in a flange 24. Similarly, the passages 21 and 22 are connected together at an orifice 25 in the flange 24. The transfer tube 17 is connected to the flange 24 via a distribution place (not shown) which connects the bore of the transfer tube 17 with both the orifices 23 and 25. Flanges 26, 27 are connected to a spin block 28 with the passages 19, 20 registering with inlet passages 29, 30, respectively, in the spin block 28 (see FIG. 5). The passages 21, 22 similarly register with inlet passages in a second spin block 31 which is the same as, but a mirror image of, the spin block 28. In FIGS. 1, 2 and 3 the spin blocks 28 and 31 are shown enclosed by heat insulating covers.

The spin block 28 houses a metering pump 32 of the meshing gear wheel type having three gear wheels and constructed to accept one infeed stream of melt and divide it into two equal metered discharge streams. An inlet port of the pump 32 registers with passage 30, and two discharge ports of the pump 32 register with passages 33 and 34, respectively. The passage 33 registers with an inlet passage 35 in a spin pack 36 (see FIG. 6). The passage 34 similarly registers with a spin pack 37. In like manner, a second metering pump 38 is connected between the inlet passage 29 and two more spin packs 39 and 40. FIG. 2 shows the four packs 36, 37, 39, and 40 covered by heat insulating covers 41, 42, 43, and 44, respectively. The pack 36 has a cover plate 45, a body 46, a breaker plate 47, a spinnerette 48 and a lifting handle 49. Wire mesh screens are disposed above and below the breaker plate which has passages 50 therethrough and the spinnerette has capillaries 51 therethrough (see FIG. 8). A bolt 52 clamps the spin pack 36 in place so that the passages 33 and 35 are in sealed register. Packs 37, 39 and 40 are similarly constructed and held in place. A band heater 53 surrounds spin block 28. Spin block 31 is similarly constructed and contains four more spin packs which are fed from passages 21 and 22 in the manifold 18.

Figure 1:
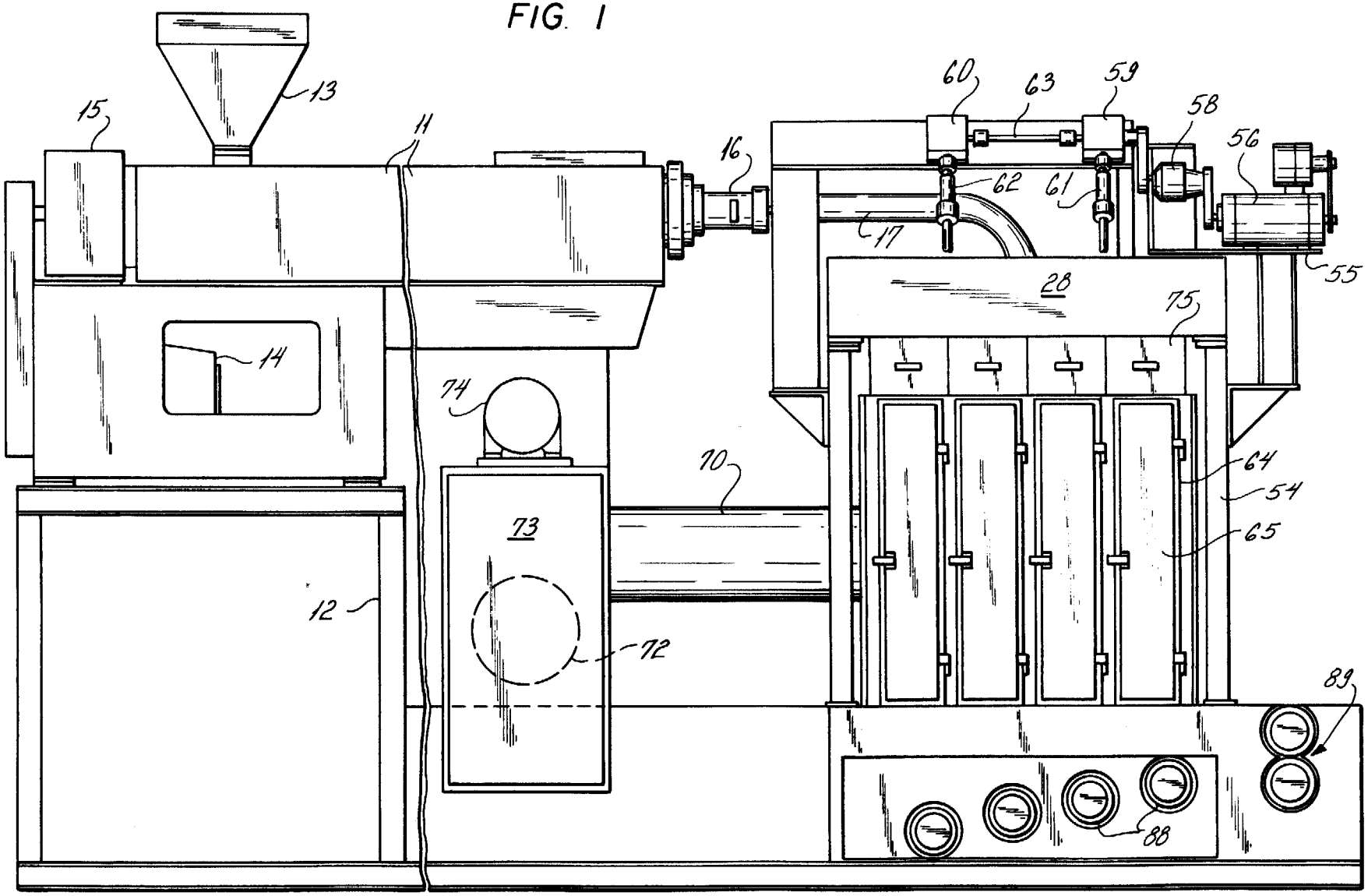
FIG. 1 is side elevational view of an extrusion apparatus according to the invention.
Figure 2:
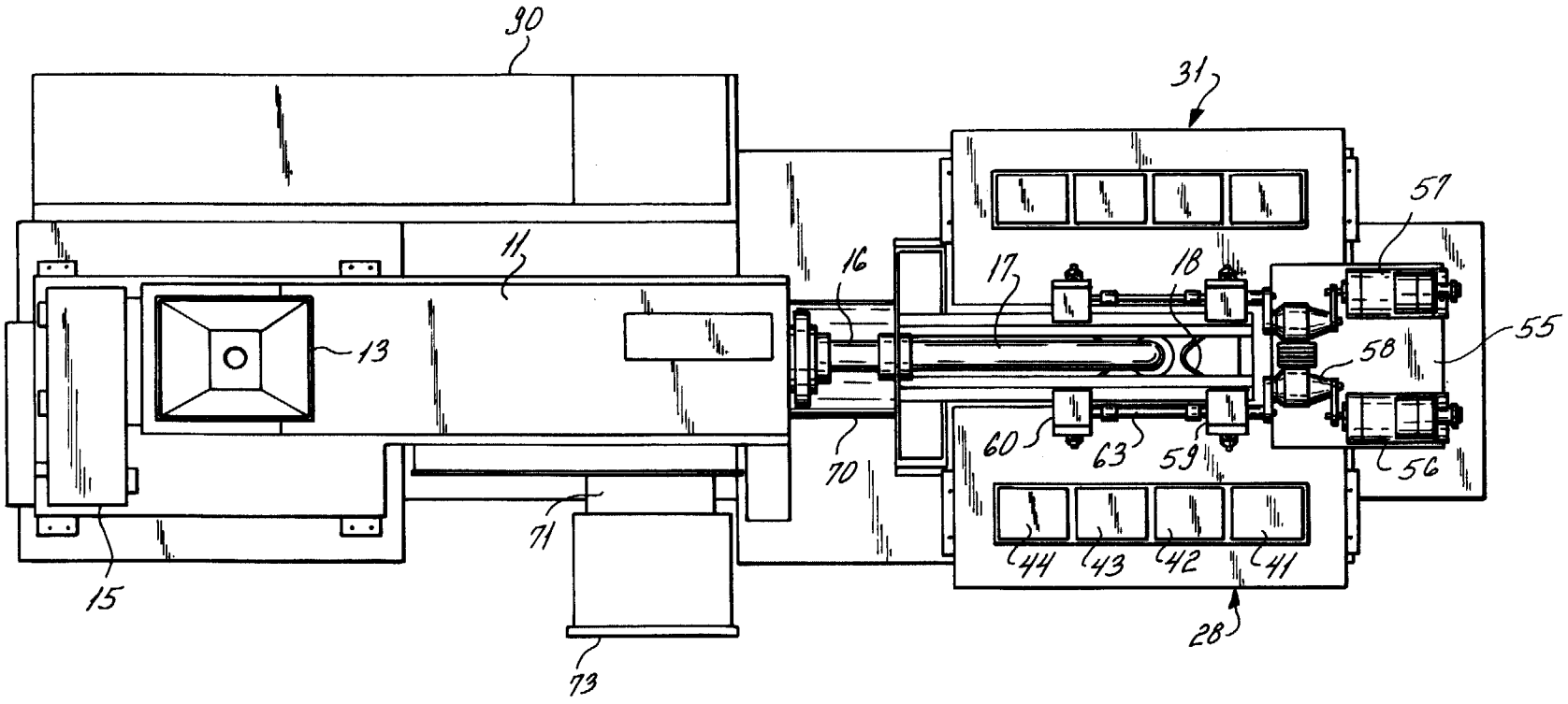
FIG. 2 is a plan view of the apparatus.
Figure 3:
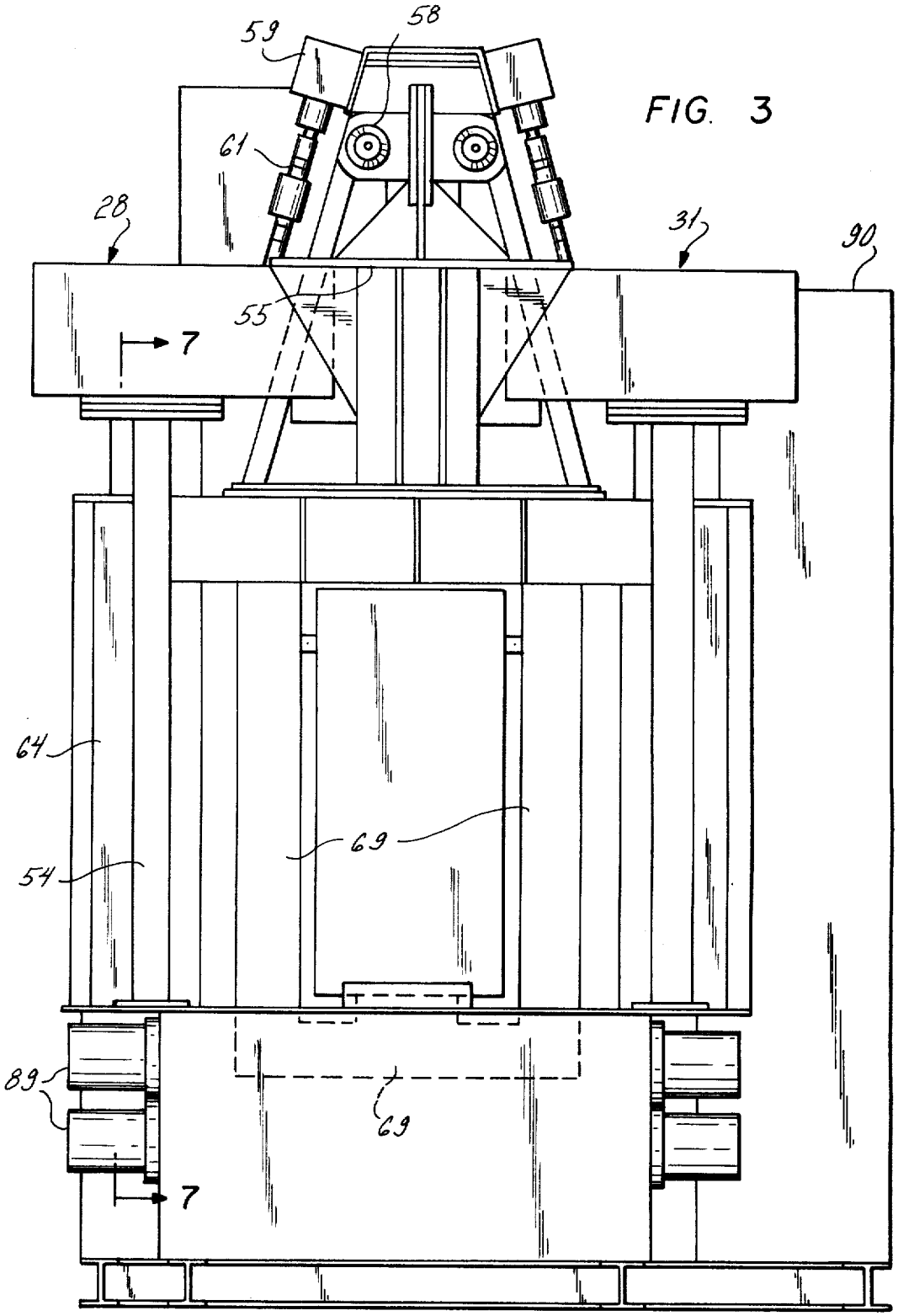
FIG. 3 is an end view of the apparatus on a larger scale.
Figure 4:
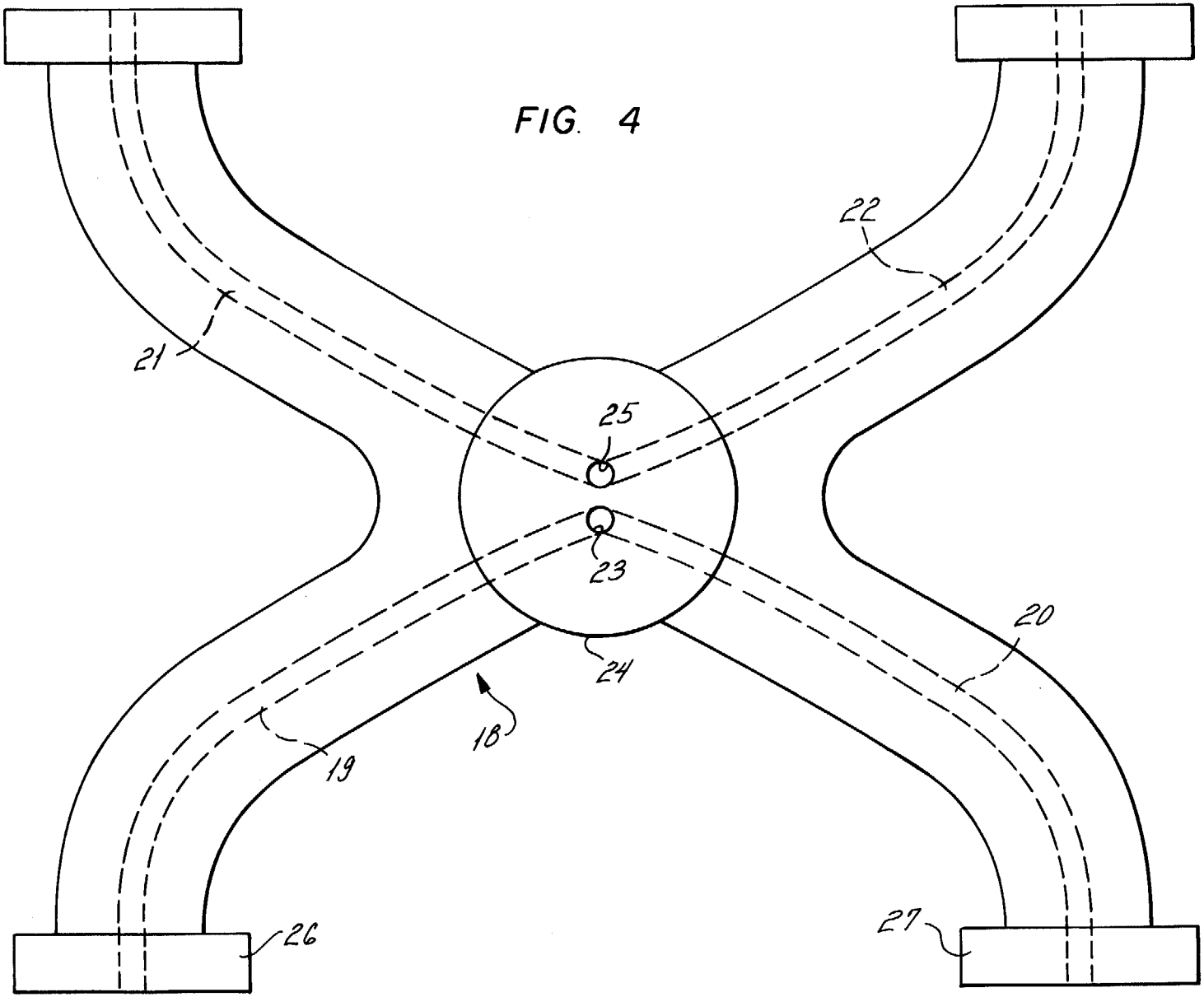
FIG. 4 is a plan view of a distribution manifold of the apparatus.
Figure 5:
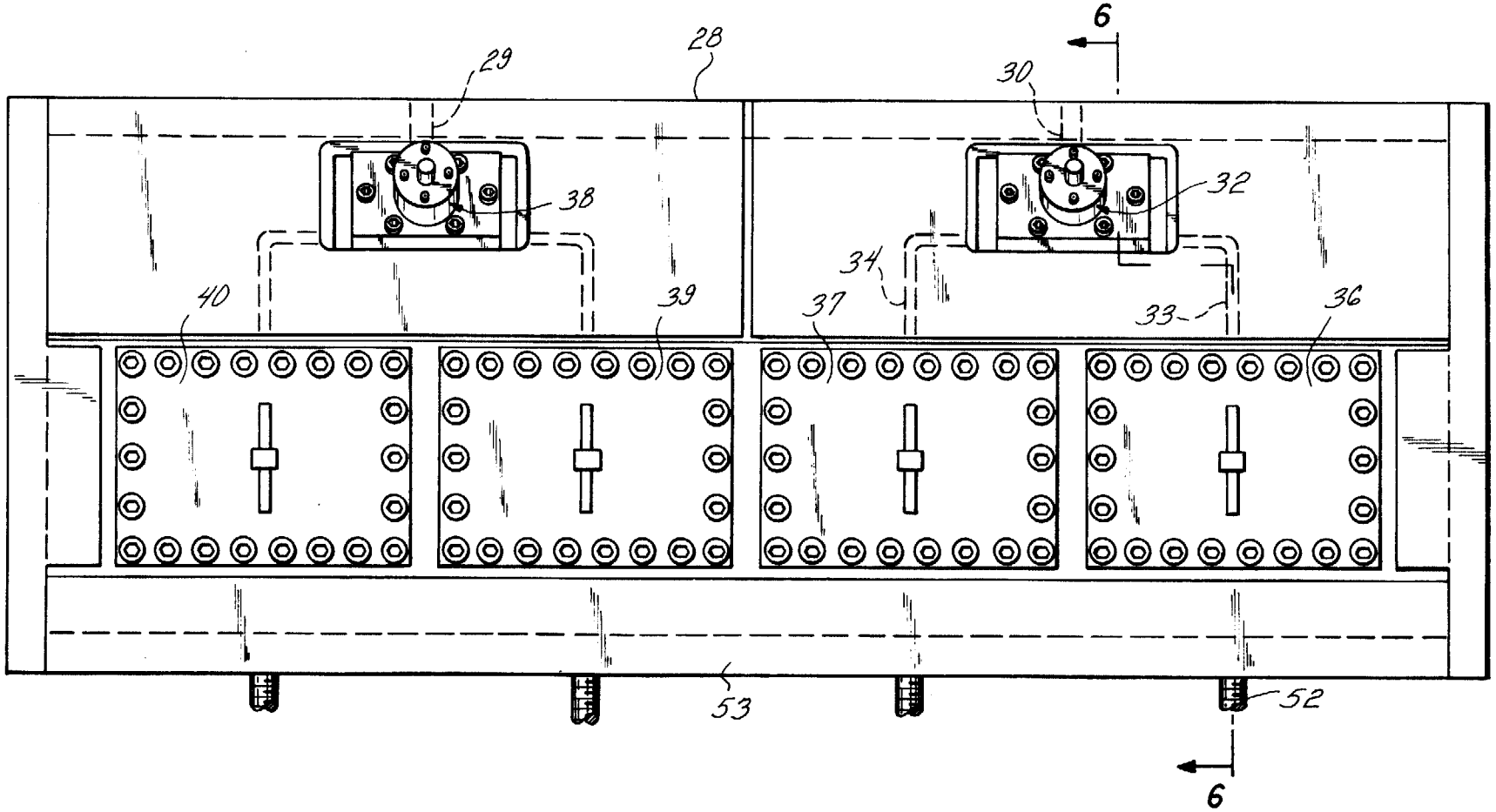
FIG. 5 is a plan view of a spin block of the apparatus.
Figure 6:
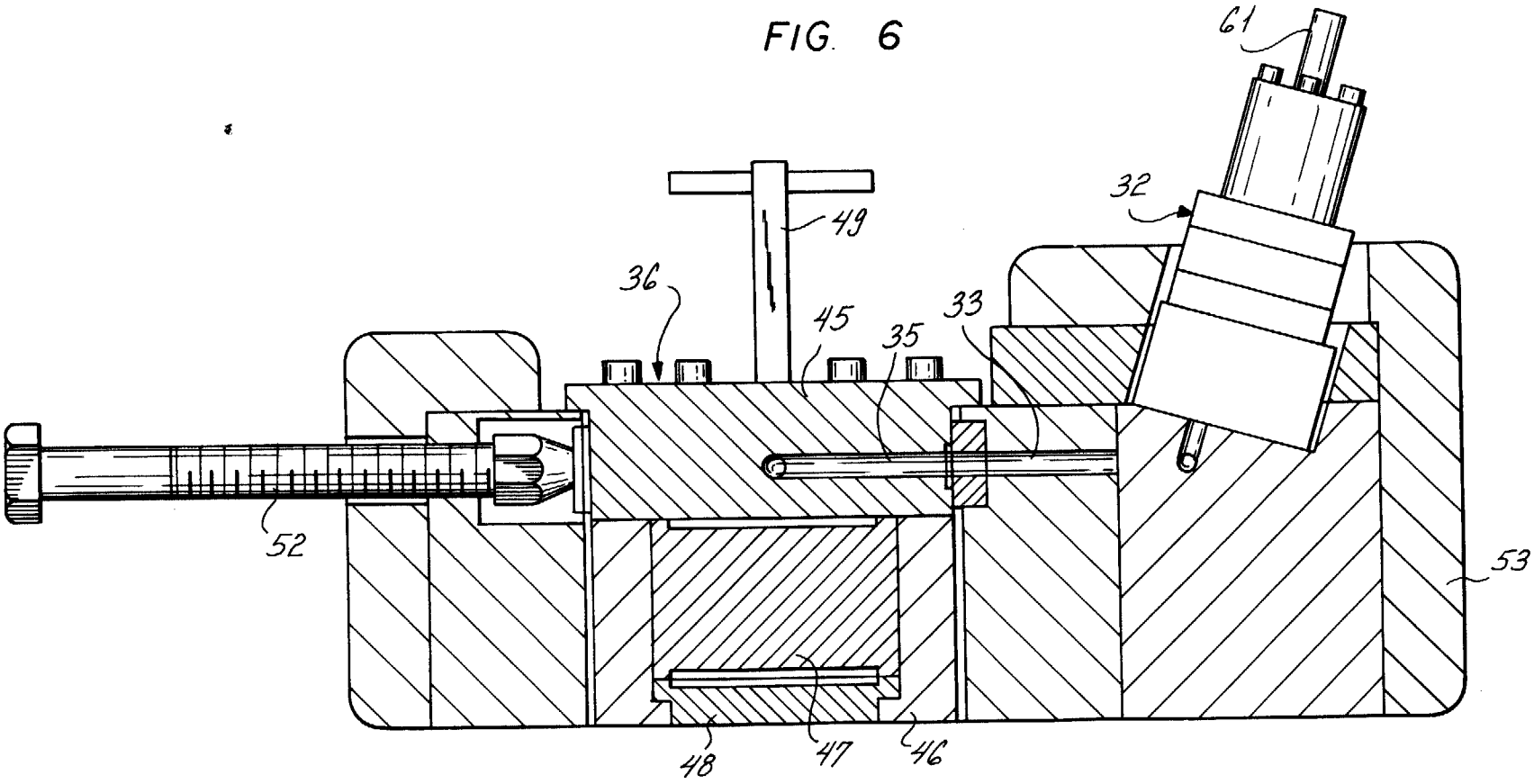
FIG. 6 is a stepped section, on a larger scale, on the line 6—6 of FIG. 5.

The spin blocks 28 and 31 are supported by pillars 54 which also support further structural members including a platform 55 on which are mounted drive motors 56 and 57. The motor 56 drives the metering pumps 32 and 38 via a reduction gear box 58, right-angled gear boxes 59, 60 and drive shafts 61 and 62. The gear box 60 is driven from the gear box 59 by a shaft 63. The two metering pumps of spin block 31 are similarly driven by the motor 57. For simplicity, the motors 56 and 57 have been omitted in FIG. 3.

Below the eight spin packs are eight quench cabinets 64, each having a door 65 at the front and being supported by structural members. The door 65 is constructed from slotted sheet metal (see FIG. 7) mounted in a frame 66 (see FIG. 8). The back of each quench cabinet is formed by wire mesh (see FIG. 7) mounted in a frame 68. The wire mesh 67 of all the quench cabinets is in communication with a plenum 69 which is connected by a duct 70 to a blower 71. The blower 71 has an air inlet 72 covered by a filter 73 and is driven by a motor 74.

Figure 7:
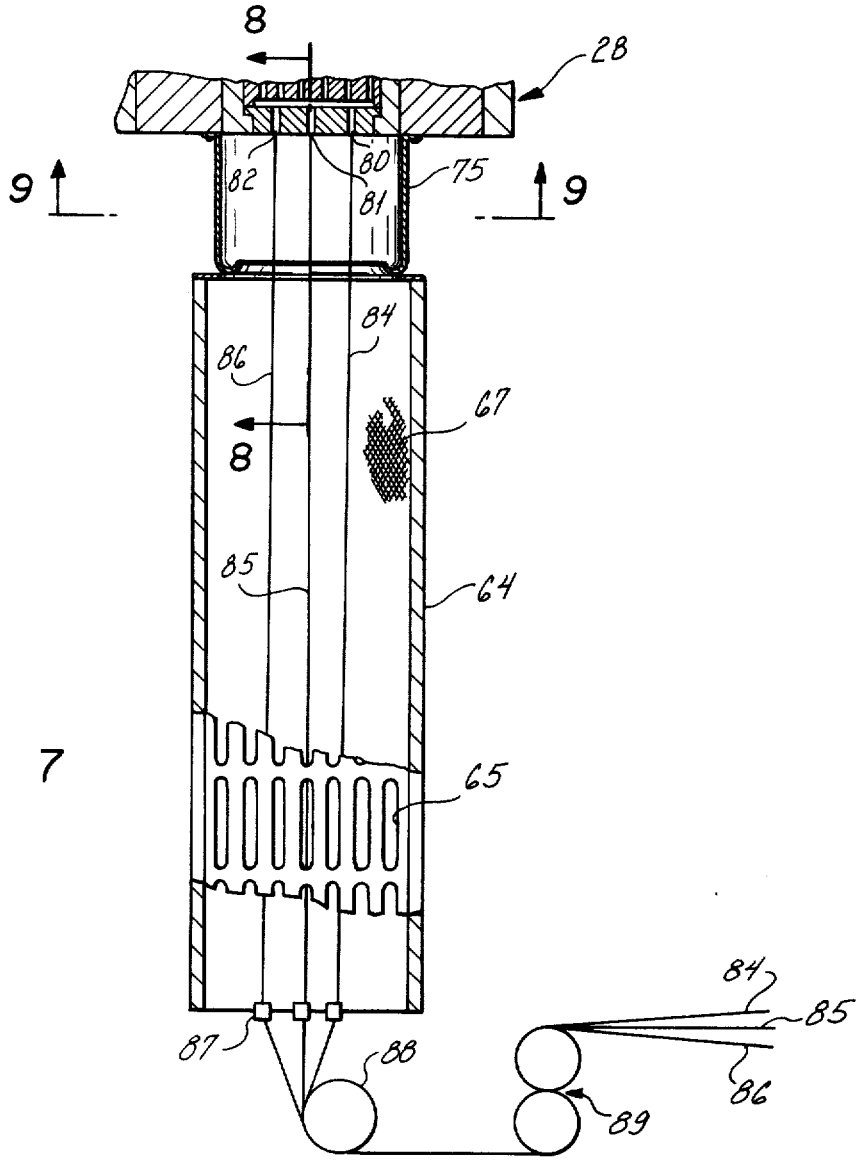
FIG. 7 is a diagrammatic section on the line 7—7 of FIG. 3 showing one spinning position.
Figure 8:
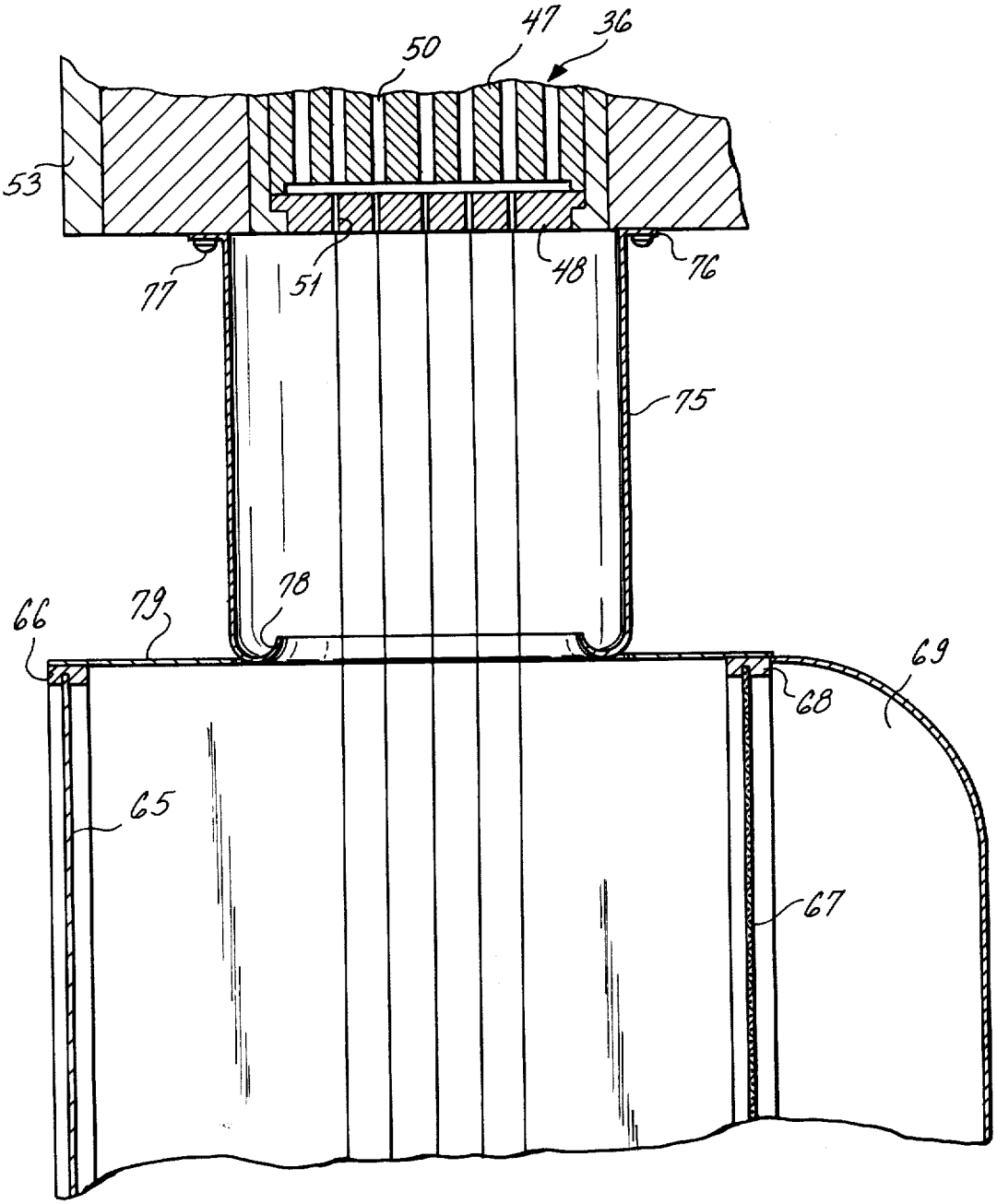
FIG. 8 is a diagrammatic section on the line 8—8 of FIG. 7, but on a larger scale.
Figure 9:
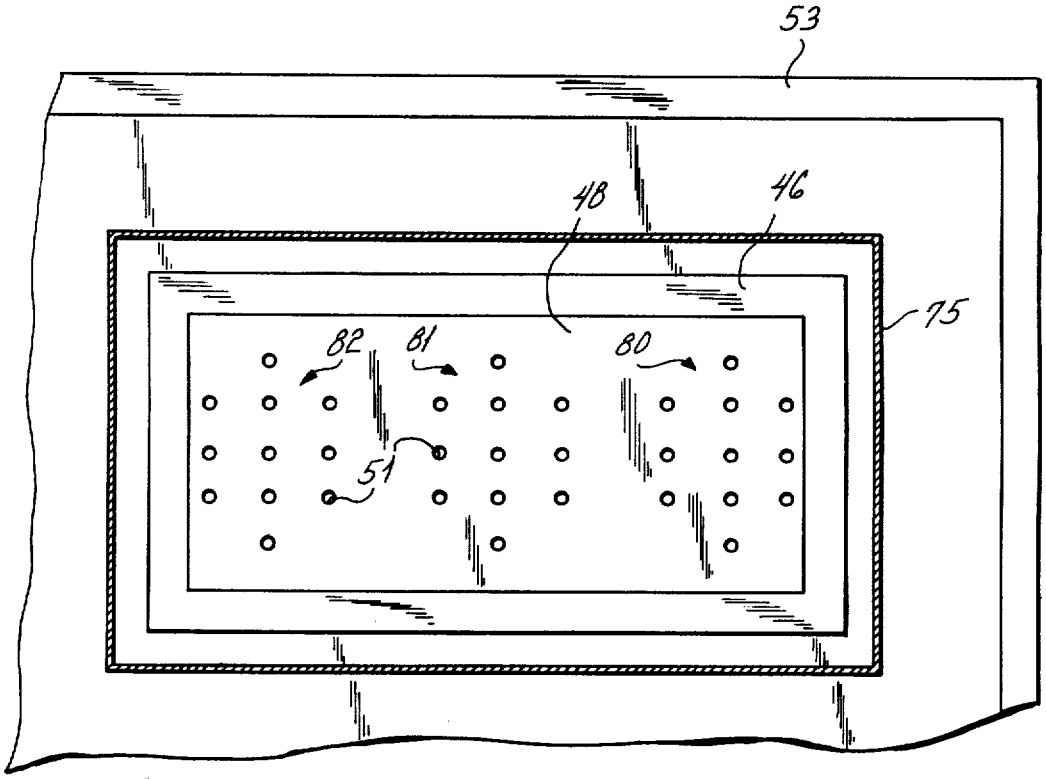
FIG. 9 is a diagrammatic sectional view on the line 9—9 of FIG. 7 on the same scale as FIG. 8.

Between the top of each quench cabinet and the spin block thereabove is a shroud 75. Referring now to FIGS. 7, 8, and 9, the shroud has a flange 76 around its upper edge and is secured to the spin block 28 by bolts 77. Around the lower edge of the shroud is a trough 78 directed inwardly. A top cover 79 of the quench cabinet fits closely around the outside of the trough 78. The shroud is rectangular in horizontal section and surround the face of the spinnerette which is also rectangular (see FIG. 9). A small spacer (not shown) is mounted on each bolt 77 between the flange 76 and the lower surface of the spin block 28 so that there is a minute clearance between the flange 76 and the spin block sufficient to reduce thermal conductivity from the spin block to the shroud 75. The front wall of the shroud 75 may have a removable panel for ease of access to the interior of the shroud and the face of the spinnerette 48.

The spinnerette has three groups 80, 81 and 82 of capillaries 51 for producing three multi-filament yarns 84, 85 and 86. The three groups 80, 81 and 82 are spaced apart in a direction parallel to the longer sides of the rectangle formed in horizontal section by the shroud 75. At the bottom of the quench cabinet 64 are three finish applying guides 87 below which is a denier control roll 88 to the discharge side of which is a pair of nip rollers 89. As can be seen, the denier control roll 88 is disposed immediately adjacent the quench cabinet 64 without the presence of an inter-floor tube.

Each of the eight spinning positions are similarly constructed but with the denier control rolls 88 being slightly staggered in the vertical direction to keep the groups of yarns from different spinning positions separate before they pass around and through the nip rollers 89.

All the various motors, drives, and heaters of the apparatus are controlled from a control cabinet 90.

In operation, pellets of thermoplastic material, particularly polypropylene, are fed via the hopper 13 into the extruder 11 where they are melted and mixed. The resulting melt is fed by the screw of the extruder through the screen shifter 16, where it is filtered, through the transfer tube 17 to the manifold 18 where it divides into four streams passing through the four passages 19, 20, 21 and 22. Each stream supplies its respective metering pump which divides the stream into two equal metered streams. Each metered stream is pumped to its respective spin pack where it hydraulically splits and is extruded through the capillaries 51 into three groups of filaments to form three multi-filament yarns 84, 85 and 86. The yarns pass through the guides 87 which apply spin finish to them before the three yarns come together and pass partly around the denier control roll 88. The three yarns then pass around and through the nipping rollers 89 which feed them to winders, at this point the three yarns separate and each multi-filament yarn is fed to a separate winder.

The air inside the shroud 75 is trapped there and remains quiescent. This air is heated by the metal above it, namely the face of the spinnerette 48, the lower end of the pack body 46 and part of the spin block 28, these being heated by the spin block heater 53. The molten filaments leaving the capillaries 51 also heat this air. In this way, the air inside the shroud 75 remains hot at a temperature close to, or just below, the temperature of the melt being extruded and prevents substantial cooling of the filaments as they pass therethrough. By extruding the filaments into the hot zone inside the shroud 75, the draw-down of the molten filaments to their undrawn denier before they solidify occurs at or closely adjacent the face of the spinnerette, and can occur uniformly at lower melt temperatures than if the molten filaments were extruded directly into a quenching zone. Also, this draw-down occurs over a shorter distance. The volume inside the shroud 75 is relatively small so that when extrusion is started up, the air inside the shroud heats up quickly. The shroud is relatively short but there is sufficient clearance between the yarns and the trough 78 to prevent the yarns when they sway touching the inside edge of the trough.

The outside of the shroud 75 is in contact with lower temperature air, and the vapors, such as low molecular weight polymers or stabilizers, given off by the filaments, while molten, condense on the inside surface of the shroud 75 and are collected in the trough 78. This condensate is manually cleaned out of the trough 78 periodically, for example when die facing or changing spin packs.

Ambient air is drawn in through the filter 73 and blown by the blower 71 through the duct 70 into the plenum 69, then passing through the wire meshes 67 transversely across the quench cabinets 64 from back to front, and is exhausted to atmosphere through the slots in the doors 65. The wire mesh 67 extends the full length of each quench cabinet and distributes from the top to the bottom uniform flow of cooling air across the quench cabinet and the yarns passing therethrough. In this way the yarns are cooled in the quench cabinet. The three yarns 84, 85, 86 are spaced apart across the quench cabinet in a direction at right angles to the direction of air flow therethrough to prevent one yarn interfering with the cooling of another. The main factor in the cooling of the yarns is the velocity of the air as it passes over the yarns and not the temperature of the air. However, if the temperature of the ambient air in the vicinity of the filter 73 is high, for example over 90° F., it may be desirable to cool the air with refrigeration units before it is blown through the quench cabinets.

By applying the spin finish to the yarns before they contact the denier control roll 88, they are gripped better by the roll 88. The speed of the roll 88 determines the undrawn denier of the yarns.

The dimensions of the shroud 75 are height 9 inches, width 12 inches, and depth 7 inches. The face of the spinnerette 48 is 8 inches long by 4 inches wide. The height of the quench cabinets is 4 feet, and the bottom of each quench cabinet is 1 feet 10 inches above the floor. The face of the spinnerette is 6 feet 7 inches above the floor. This enables an average height operator to reach the spinnerette face and any part of the yarn path while standing on the floor. This is particularly advantageous when extrusion is being started-up, for example after a spin pack change, as the operator, while standing on the floor, can separate the three yarns at each spinning position a short distance below the spinnerette and then follow the separation through the guides 87 and from the nip rollers 89.

The overall height of the apparatus (including the hopper 13) is 10 feet 9 inches, the overall length (excluding winders) 19 feet, and the width 7 feet. Thus it can be seen that this is a compact extrusion apparatus that can be installed in a single story building.

The extruder has a barrel diameter of 3 inches and a length over diameter ratio of the barrel of 30:1.

The following is an example of the production of a polypropylene yarn with the above extrusion apparatus. Polypropylene resin was used having a narrow molecular weight distribution and a melt flow of 30. The temperature profile of the extruder was set to give an extrusion temperature of 400° F. The metering pumps were set to produce each metered stream at the rate of 24 pounds per hour with the extruder output being 192 pounds per hour. Ambient air at 85° F. was blown through the quench cabinets at 100 feet per minute. The delivery speed of the yarns from the denier control rolls 88 was 600 meters per minute. Each yarn had 70 filaments and an undrawn denier of 900. When subsequently drawn at a 3:1 draw ratio to 300 denier the final continuous filament yarn was suitable for use as an upholstery filling yarn. It will be noticed that although the length of the yarn path from the spinnerette to the denier control roll is less than 7 feet, the speed of the extruded yarn is surprisingly high.

What is claimed is:

1. Air quench extrusion apparatus for producing polypropylene yarns, comprising:

(a) an extruder mounted on a frame which supports the extruder near the top of and lengthwise of the apparatus, said frame comprising means for supporting the extruder above a floor of a building;

(b) a transfer tube extending forwardly from the extruder in the lengthwise direction of the apparatus.

(c) a distribution manifold connected to the transfer tube and extending laterally on opposite sides thereof;

(d) two spin blocks disposed one on each side of the apparatus and being connected to said manifold, each spin block extending in the lengthwise direction of the apparatus forwardly of said extruder;

(e) a plurality of quench cabinets arranged in two rows extending in the lengthwise direction of the apparatus with one row on each side of the apparatus below the spin block on that side of the apparatus, each quench cabinet being arranged for air to be blown through it laterally of the lengthwise direction of the apparatus and from inside of the apparatus outwardly;

(f) a plurality of shrouds, one being associated with each quench cabinet and defining quiescent hot zone between said quench cabinet and the spin block above it, each shroud being less than two feet long;

(g) a plurality of denier control roll means, one being disposed adjacent to and below each quench cabinet, and each such denier control roll means being adjacent said floor and less than eight feet below the bottom of the shroud associated with the quench cabinet above such denier control means;

(h) nip roll means arranged on each side of the apparatus and disposed in the lengthwise direction of the apparatus forward of said denier control roll means;

(i) said denier control roll means on each side of the apparatus being staggered in the vertical direction to allow separate yarn paths from said denier control roll means forwardly to said nip roll means on that side of the apparatus; and (j) the arrangement being such that the apparatus can be installed and operated in a single story building.

2. An apparatus as claimed in claim 1 in which there are at least four quench cabinets in each side row.

3. An apparatus as claimed in claim 2 having a plurality of spinnerettes, one associated with each said shroud, and each spinerette having at least three groups of capillaries spaced apart in the lengthwise direction of the apparatus for the extrusion of at least three multifilament yarns through each shroud and associated quench cabinet.

4. An apparatus as claimed in claim 2 having an air blower mounted underneath said extruder, said blower having an air intake and a discharge duct, said intake being in communication with ambient air, and said discharge duct being connected to a plenum in communication with all said quench cabinets.

5. An apparatus as claimed in claim 1 in which each shroud has an outside wall having a removable panel for ease of access to the interior of that shroud.

* * * * *